US011504575B2

(12) United States Patent
Chen

(10) Patent No.: US 11,504,575 B2
(45) Date of Patent: Nov. 22, 2022

(54) ELLIPTICAL TRAINER IN LINE WITH HUMAN FACTORS ENGINEERING

(71) Applicant: JOONG CHENN INDUSTRY CO., LTD., Nantou (TW)

(72) Inventor: James Chen, Nantou (TW)

(73) Assignee: JOONG CHENN INDUSTRY CO., LTD., Nantou (TW)

( * ) Notice: Subject to any disclaimer, the term of this patent is extended or adjusted under 35 U.S.C. 154(b) by 139 days.

(21) Appl. No.: 16/992,852

(22) Filed: Aug. 13, 2020

(65) Prior Publication Data

US 2021/0138300 A1 May 13, 2021

(30) Foreign Application Priority Data

Nov. 8, 2019 (TW) ..... 108140691

(51) Int. Cl.

| | |
|---|---|
| ***A63B 22/06*** | (2006.01) |
| ***A63B 22/00*** | (2006.01) |
| ***A63B 21/22*** | (2006.01) |
| ***A63B 21/00*** | (2006.01) |

(52) U.S. Cl.

CPC ..... *A63B 22/0664* (2013.01); *A63B 21/225* (2013.01); *A63B 21/4034* (2015.10); *A63B 21/4035* (2015.10); *A63B 22/001* (2013.01); *A63B 2022/0682* (2013.01)

(58) Field of Classification Search

CPC ..... A63B 22/0664; A63B 21/4035; A63B 21/225; A63B 2022/0682; A63B 2022/0043; A63B 22/0048; A63B 22/0056; A63B 22/0061; A63B 22/0064; A63B 2022/067; A63B 2022/0866; A63B 22/001; A63B 21/4034; A63B 21/1263; A62B 21/4034

See application file for complete search history.

(56) References Cited

U.S. PATENT DOCUMENTS

| | | | | |
|---|---|---|---|---|
| 7,744,508 | B2 * | 6/2010 | Liao | A63B 22/0015 482/52 |
| 9,579,537 | B1 * | 2/2017 | Peng | A63B 22/0664 |
| 10,022,586 | B1 * | 7/2018 | Lee | A63B 22/0664 |
| 2016/0375300 | A1 * | 12/2016 | Chang | A63B 22/001 482/52 |
| 2017/0106231 | A1 * | 4/2017 | Liao | A63B 69/0057 |
| 2018/0185698 | A1 * | 7/2018 | Anderson | A63B 22/001 |

FOREIGN PATENT DOCUMENTS

| | | | | |
|---|---|---|---|---|
| WO | WO-2017165393 | A1 * | 9/2017 | A63B 21/00069 |

* cited by examiner

*Primary Examiner* — Megan Anderson

(74) *Attorney, Agent, or Firm* — Muncy, Geissler, Olds & Lowe, P.C.

(57) ABSTRACT

An elliptical trainer includes a machine table, a transmission unit, two pedal units and two suspension arms. Each pedal unit has a pedal rod and a guide. The pedal rod has a front end thereof pivoted to one respective crank arm, and an opposing rear end thereof pivoted to one respective pedal seat. The pedal seat has the top surface thereof bearing one respective pedal. Each suspension arm has two opposite ends of a bottom side thereof respectively pivoted to the machine table and the rear end of one respective pedal rod. Each suspension arm is skewed in the direction of the pedal, so that each suspension arm can guide the pedal forward along a straight line direction and backward along a diagonal direction.

6 Claims, 5 Drawing Sheets

ELLIPTICAL TRAINER IN LINE WITH HUMAN FACTORS ENGINEERING

BACKGROUND OF THE INVENTION

1. Field of the Invention

The present invention relates to exerciser technology and more particularly, to an elliptical trainer in line with human factors engineering.

2. Description of the Related Art

Elliptical trainer is a cardiopulmonary fitness training equipment developed in recent years. It mainly allows users to move along an approximately elliptical trajectory when stepping on the left and right pedals to simulate walking, running and stair climbing and other leg exercises.

The left and right pedals of the traditional elliptical trainer are designed to be parallel to each other, and in terms of movement trajectory, they are forward and backward in a straight line. However, most people will have a habit of walking in the inner or outer Bazi position, so when using a traditional elliptical trainer for training, it is easy to cause the lower limb joints (such as the knee or hip joint) to be at an inappropriate angle of movement. As time passes, it can cause sports injuries such as muscle soreness or joint inflammation. It can be seen that conventional elliptical trainers are difficult for users to train in postures or movements that conform to human factors engineering.

SUMMARY OF THE INVENTION

The present invention has been accomplished under the circumstances in view. It is the main object of the present invention to provide an elliptical trainer, which allows the user to train in a posture that conforms to human factors engineering to reduce the burden on the joints of the lower limbs.

To achieve this and other objects of the present invention, an elliptical trainer comprises a machine table, a transmission unit, two pedal units, two armrest units, and two suspension arms. The machine table comprises a base, an upright set at a front end of the base and two side frames respectively set on opposing left and right sides of the base. The transmission unit comprises a crankshaft rotatably installed on the upright, a flywheel fixed to the crankshaft to rotate with the crankshaft, and two crank arms having a respective front end thereof fixed to the crankshaft so that the two crank arms can drive the crankshaft to rotate the flywheel under an external force. The two pedal units are symmetrical with respect to a first axis. Each pedal unit comprises a pedal rod, a pedal seat and a pedal. The pedal rod has a front end thereof pivoted to a rear end of one respective crank arm in a left and right swingable manner. The pedal seat is pivotable up and down on a top surface of an opposing rear end of the pedal rod. The pedal is fixed on a top surface of the pedal seat, so that when the pedal is subjected to the pedaling force, the transmission unit will be driven by the pedal rod, and then the transmission unit will move along an elliptical trajectory. Each armrest unit comprises an armrest and a link. The armrest is pivoted to the upright of the machine table in a back and forth swingable manner. The link has a front end thereof pivoted to a bottom end of the armrest in a back and forth swingable manner, and an opposing rear end thereof fixed to one respective pedal seat. Each suspension arm has a top end thereof pivoted to one respective side frame of the machine table in a back and forth swingable manner, and an opposing bottom end thereof pivoted to the rear end of one respective pedal rod in a back and forth swingable manner. In addition, each of the suspension arms is skewed in the direction of the pedal, so that each of the suspension arms can pivot around a second axis that is not perpendicular to the first axis, so as to guide the pedal to move forward along a straight line direction and back along a diagonal direction.

It can be seen from the above that the elliptical trainer of the present invention adjusts the movement trajectories of the left and right pedals to the way that ordinary people walk, so that the user can train in a posture that conforms to human factors engineering, so as to reduce the burden on the lower limb joints and effectively avoid sports injuries.

Preferably, each pedal rod has a front oblique section and a rear oblique section connected to the front oblique section. The front oblique section has a front end thereof pivoted to the rear end of one respective crank arm in a left and right swingable manner. The rear oblique section has a rear end thereof pivoted to a bottom end of one suspension arm in a back and forth swingable manner. The inclination angle of the upper oblique section relative to the ground is smaller than the inclination angle of the lower oblique section relative to the ground.

Preferably, each suspension arm has an upper oblique section and a lower oblique section connected to the upper oblique section. The upper oblique section has a top end thereof pivoted to one respective side frame of the machine table in a back and forth swingable manner. The lower oblique section has a bottom end thereof pivoted to the rear end of the rear oblique section of one respective pedal rod in a back and forth swingable manner. The skew angle of the upper oblique section relative to the side frames is smaller than the skew angle of the lower oblique section relative to the side frames.

Preferably, each armrest comprises a grip, a swing arm and a linkage plate. The grip is pivoted to the upright of the machine table in a back and forth swingable manner. The swing arm is disposed at a front side relative to the grip, having a top end thereof pivoted to the upright of the machine table in a back and forth swingable manner and an opposing bottom end thereof pivoted to the front end of the link to swing back and forth and left and right. The linkage plate has opposing front and rear ends thereof respectively pivoted to a bottom end of the grip and the top end of the swing arm.

The detailed structure, characteristics, assembly or use of the elliptical trainer that meets the human factors engineering provided by the present invention will be described in the detailed description of the subsequent preferred embodiment. However, those with ordinary knowledge in the field of the present invention should be able to understand that these detailed descriptions and the specific preferred embodiment listed in the implementation of the present invention are only used to illustrate the present invention, and are not intended to limit the scope of the patent application of the present invention.

DETAILED DESCRIPTION OF THE INVENTION

Figure 1:
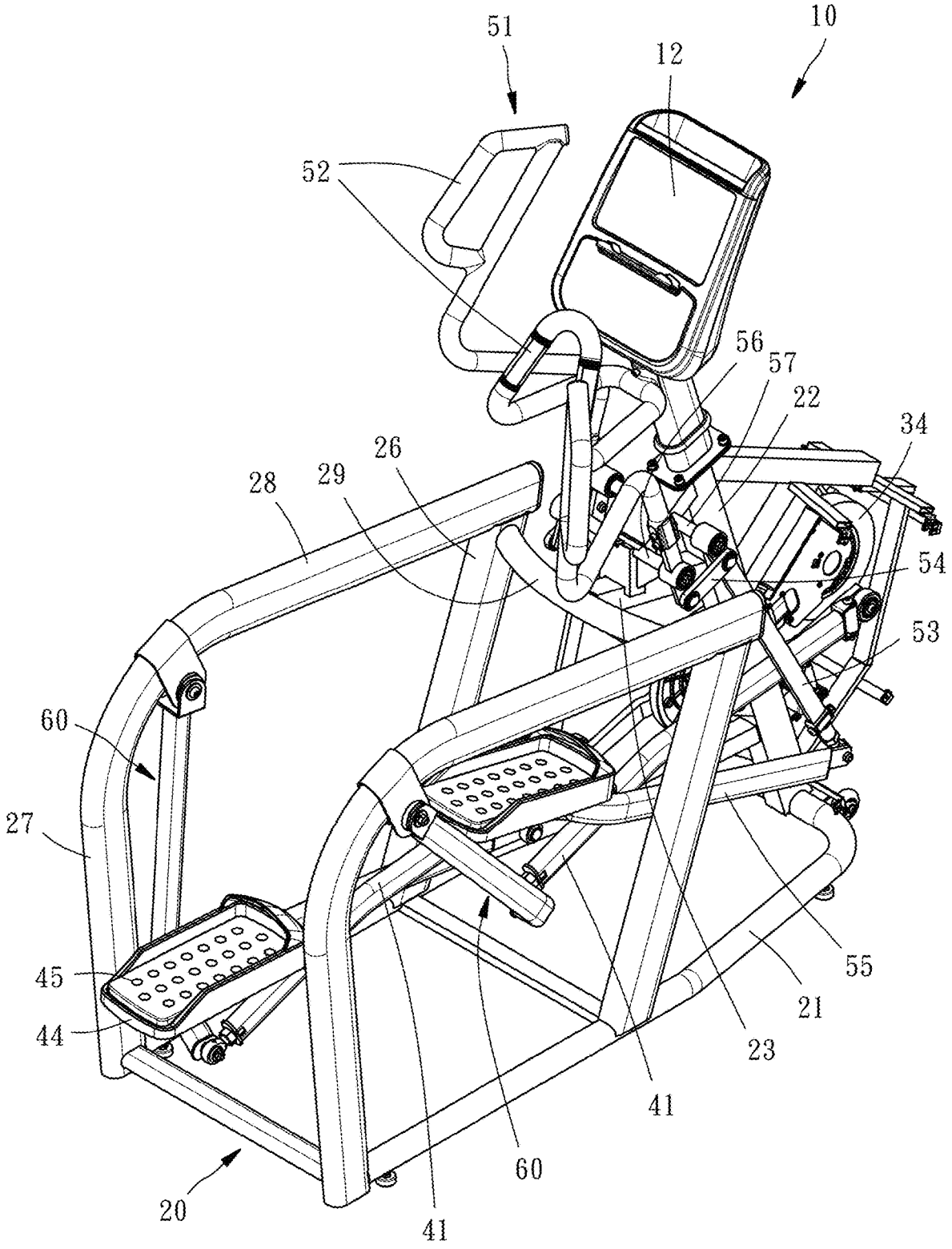
FIG. 1 is an oblique top elevational view of an elliptical trainer in accordance with the present invention.

The applicant first explains here that throughout the specification, including the preferred embodiment described below and the claims in the scope of the patent application, the nouns related to directionality are based on the directions in the drawings. Secondly, in the preferred embodiment and drawings that will be introduced below, the same element numbers represent the same or similar elements or their structural features.

Figure 2:
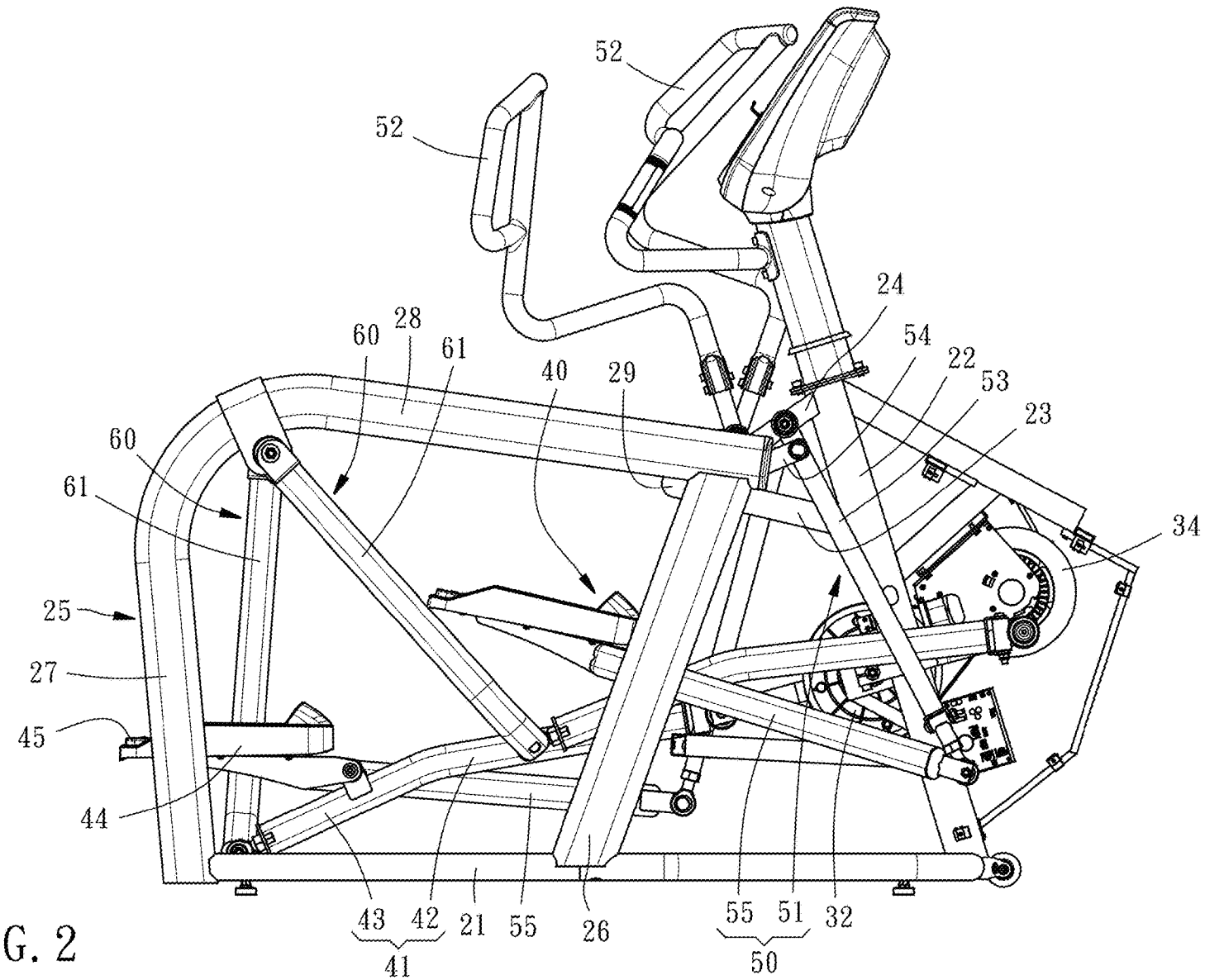
FIG. 2 is a side view of the elliptical trainer in accordance with the present invention.
Figure 3:
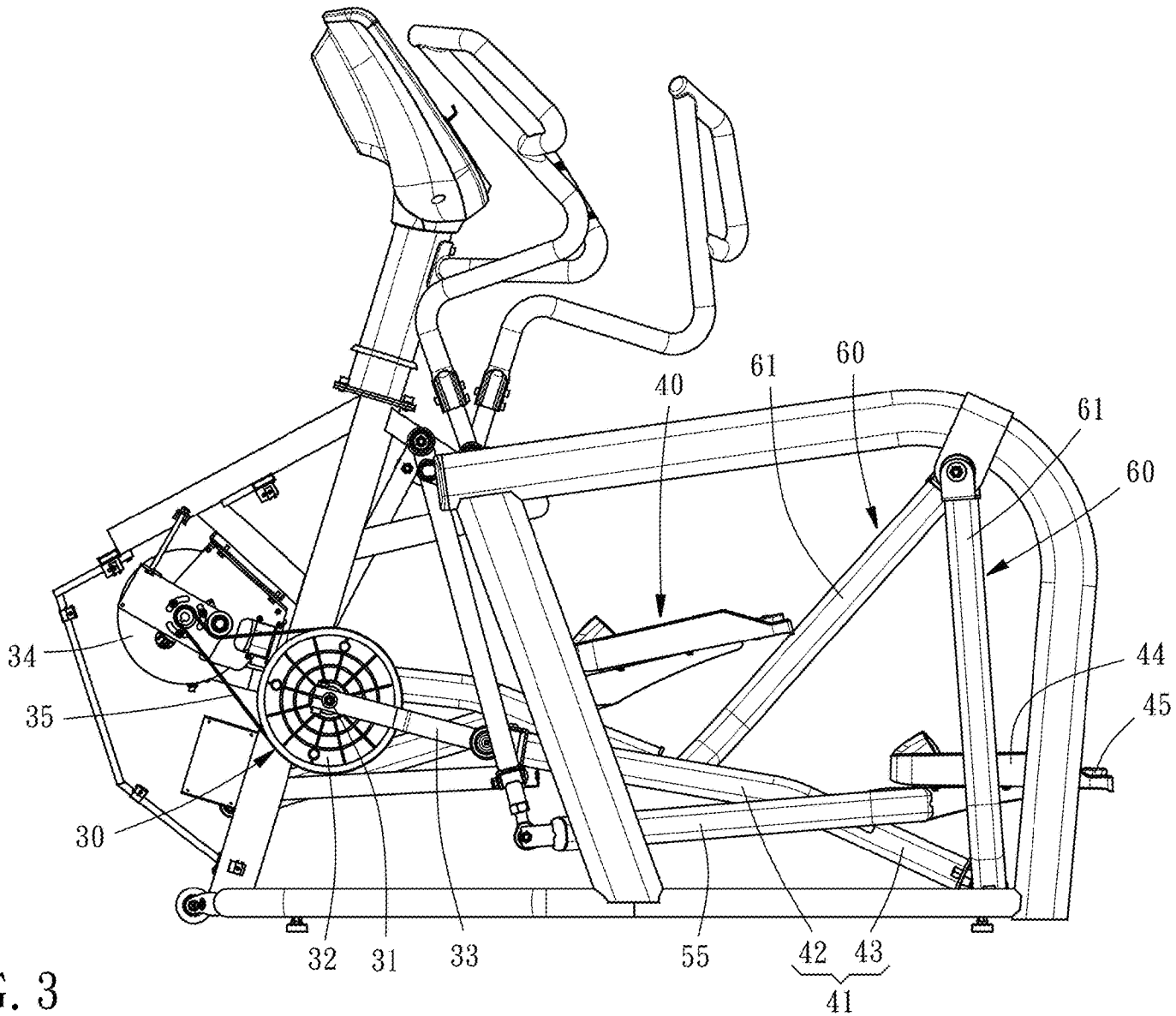
FIG. 3 is a rear view of the elliptical trainer in accordance with the present invention.

Referring to FIGS. 1-3, an elliptical trainer 10 in accordance with the present invention is shown. The elliptical trainer 10 comprises a machine table 20, a transmission unit 30, two pedal units 40, two armrest units 50, and two suspension arms 60. In order to facilitate the display of technical features, here may I clarify that some elements of the machine table 20 are omitted in the various drawings.

Referring to FIGS. 1-3, the machine table 20 comprises a base 21, an upright 22 and two side frames 25 opposite to each other. The upright 22 has a bottom end thereof fixed to a front end of the base 21, and an opposing top end equipped with a control panel 12. Each side frame 25 has a front vertical rod 26, a rear vertical rod 27 and a transverse rod 28. The front vertical rod 26 has a bottom end thereof fixed to a middle part of the base 21. The rear vertical rod 27 has a bottom end thereof fixed to an opposing rear end of the base 21. The transverse rod 28 has opposing front and rear ends thereof respectively fixedly connected to an opposing top end of the front vertical rod 26 and an opposing top end of the rear vertical rod 27, and there is a chamfer between the rear end of the transverse rod 28 and the top end of the rear vertical rod 27. In addition, the front vertical rods 26 of the two side frames 25 are jointly fixed to an extension rod 23 of the upright 22 by an arc rod 29.

Referring to FIGS. 2 and 3, the transmission unit 30 comprises a crankshaft 31, a flywheel 32 and two crank arms 33. The crankshaft 31 is rotatably installed on the upright 22. The flywheel 32 is located on a left side of the upright 22 and fixed to the crankshaft 31, so that the flywheel 32 can rotate with the crankshaft 31. The two crank arms 33 have a respective front end thereof fixed to the crankshaft 31, so that the two crank arms 33 can drive the flywheel 32 to rotate through the crankshaft 31 when the two crank arms 33 are subjected to external force. In addition, the transmission unit 30 further comprises a resistance wheel 34. The resistance wheel 34 is located on a front side of the upright 22 and uses a drive belt 35 to connect to the flywheel 32 to provide resistance to the flywheel 32 to increase the training intensity, and the resistance can be adjusted according to actual needs. As to how the resistance wheel 34 generates resistance and how to adjust the resistance are conventional art and not the focus of this application, in order to save space, these techniques are not repeated here.

Figure 4:
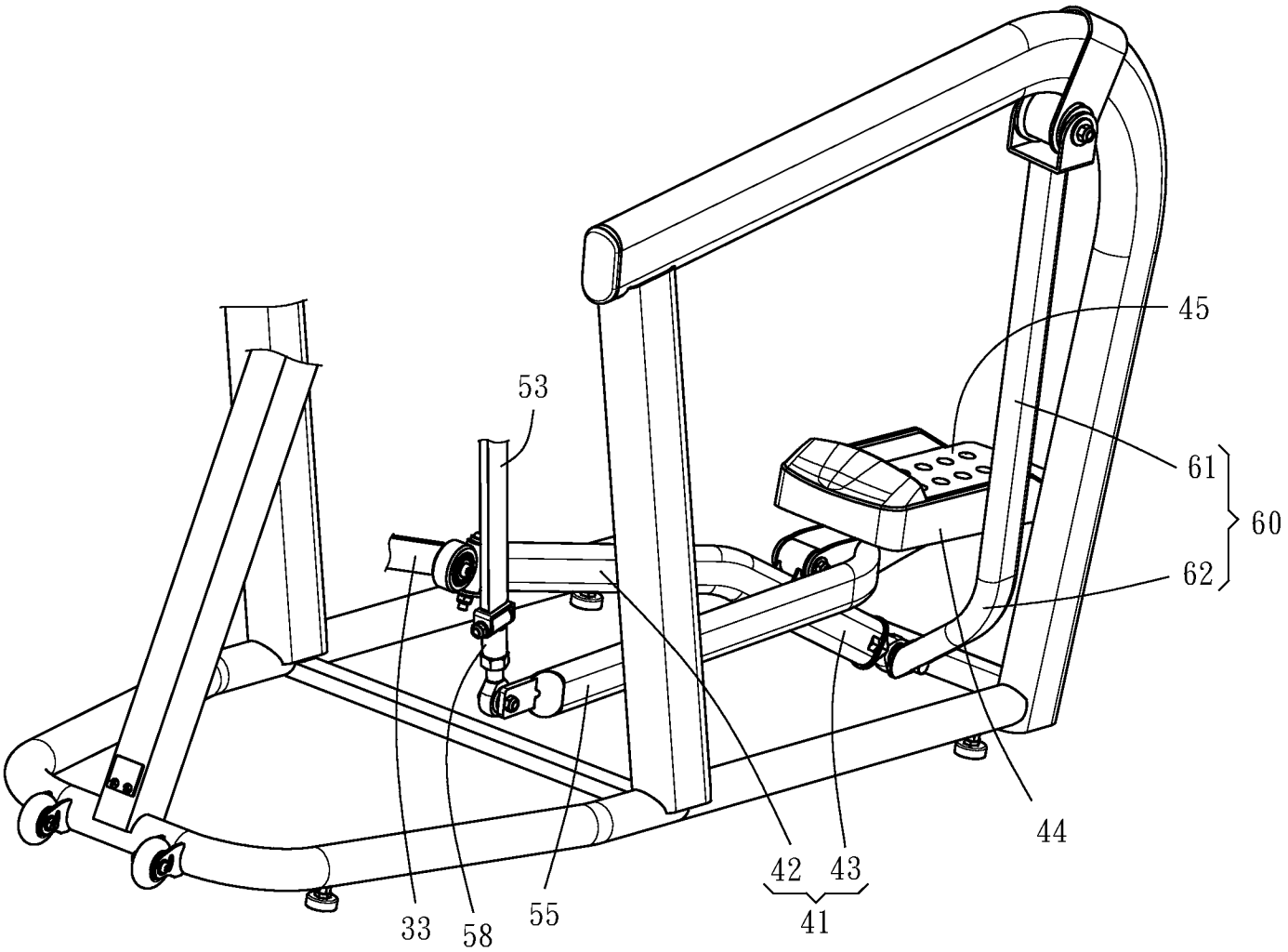
FIG. 4 is an elevational view of the elliptical trainer of the present invention with some components omitted.
Figure 5:
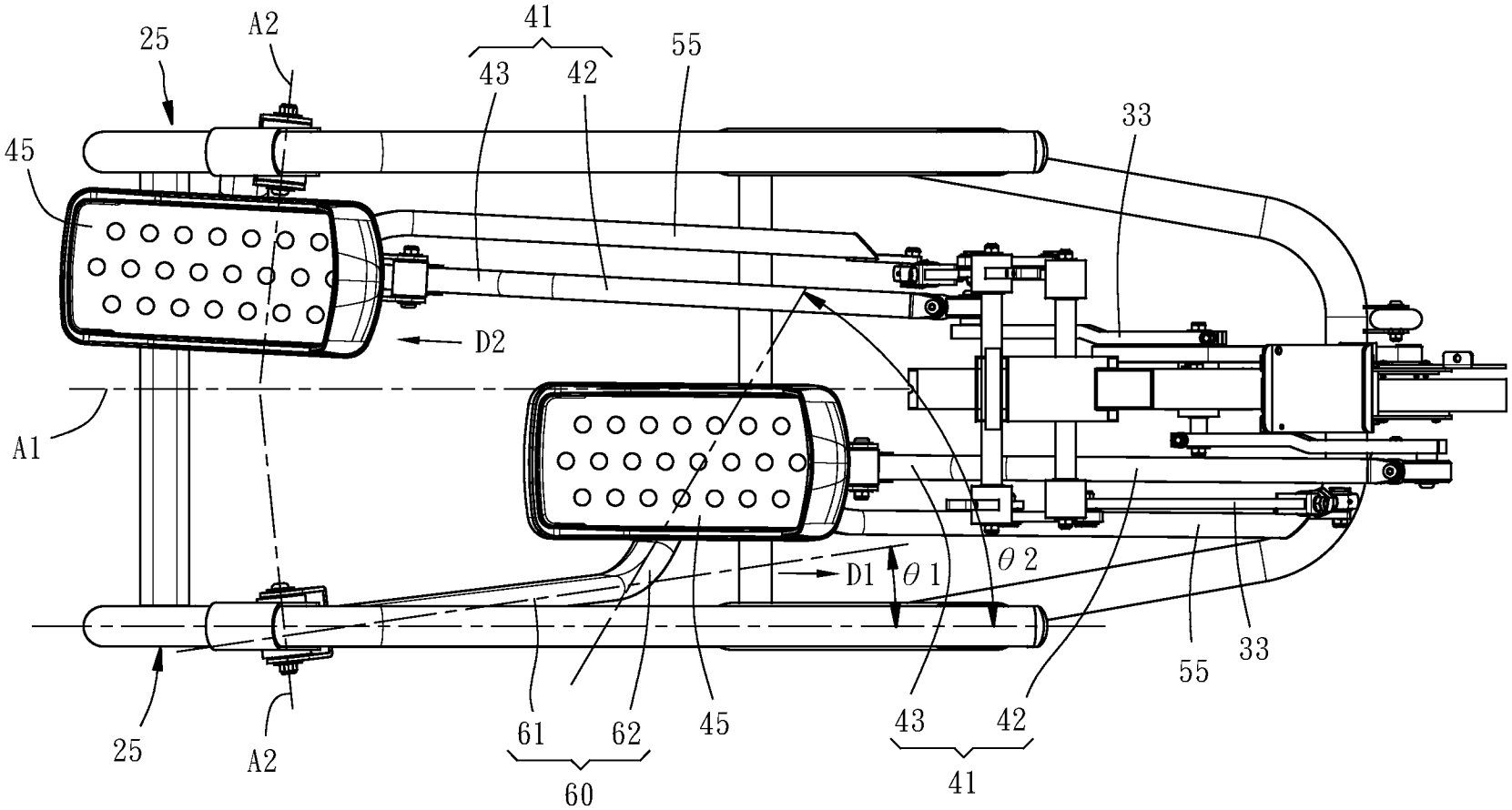
FIG. 5 is a top view of the elliptical trainer of the present invention with some components omitted.

As shown in FIG. 5, the two pedal units 40 are symmetrical with respect to a first axis A1. As shown in FIGS. 2-4, each pedal unit 40 comprises a pedal rod 41, a pedal seat 44 and a pedal 45. The pedal rod 41 has a front oblique section 42 and a rear oblique section 43 connected to the front oblique section 42. The inclination angle of the front oblique section 42 with respect to the ground is smaller than the inclination angle of the rear oblique section 43 with respect to the ground. A front end of the front oblique section 42 of the pedal rod 41 remote from the rear oblique section 43 is pivotally connected to an opposing rear end of the respective crank arm 33, so that the pedal rod 41 can drive the respective crank arm 33 to rotate on the one hand, and on the other hand can swing around the respective crank arm 33. The pedal seat 44 is pivoted up and down on a top surface of the rear oblique section 43 of the pedal rod 41, so that the pedal seat 44 moves along with the pedal rod 41. The pedal 45 is fastened to a top surface of the pedal seat 44 by using fixing elements such as screws, so that the pedal 45 moves together with the pedal seat 44.

The two armrest units 50 are located on opposing left and right sides of the upright 22 of the machine table 20. As shown in FIGS. 1-3, each armrest unit 50 comprises an armrest 51 and a link 55. The armrest 51 comprises a grip 52, a swing arm 53, a linkage plate 54, and a multi-direction pivoting member 58. The grip 52 has a top end thereof provided for the user to hold, and an opposing bottom end thereof pivoted to a first pivot 56 in a way that can swing back and forth, and the first pivot 56 is fixed to an inclined part 24 of the upright 22. The swing arm 53 is located in front of the grip 52. The multi-direction pivoting member 58 is provided with a left-and-right pivoting portion and a back-and-forth pivoting portion. The swing arm 53 has a top end thereof pivoted to a second pivot 57, which is fixed to the inclined part 24 of the upright 22, in a way that can swing back and forth, and an opposing bottom end thereof pivoted to the left-and-right pivoting portion of the multi-direction pivoting member 58 to swing left and right, and a front end of the link 55 is pivoted to the back-and-forth pivoting portion of the multi-direction pivoting member 58 in a way that can swing back and forth. The link 55 has an opposing rear end thereof fixed to an outer side of the pedal seat 44, so that swing arm 53 swings back and forth with the pedal rod 41 through the link 55. The linkage plate 54 has opposing front and rear ends thereof respectively pivoted to the bottom end of the grip 52 and the top end of the swing arm 53, so that the grip 52 swings back and forth with the swing arm 53.

As shown in FIG. 5, the two suspension arms 60 are symmetric with respect to the first axis A1. As shown in FIGS. 2-4, each suspension arm 60 has an upper oblique section 61 and a lower oblique section 62 connected to the upper oblique section 61. A top end of the upper oblique section 61 remote from the lower oblique section 62 is pivotally connected to the side frame 25 of the machine table 20 in a way that can swing back and forth. A rear end of the lower oblique section 62 is pivotally connected to a rear end of the rear oblique section 43 of the respective pedal rod 41 in a way that can swing back and forth, so that each suspension arm 60 swings back and forth with the opposite pedal rod 41.

In addition, each suspension arm 60 is skewed inward in the direction of pedal 45. The skew angle θ1 of the upper oblique section 61 of each suspension arm 60 relative to the side frame 25 is smaller than the skew angle θ2 of the lower oblique section 62 of each suspension arm 60 relative to the side frame 25. Thereby, when each suspension arm 60 swings back and forth along with the pedal rod 41 that is pivotally connected to it, as shown in FIG. 5, each suspension arm 60 can pivot on a second axis A2 that is not perpendicular to the first axis A1.

It can be seen from the above that when the user steps on the pedal 45, the pedal rod 41 will swing back and forth through the pedal seat 44. When the pedal rod 41 swings back and forth, it will drive the crank arm 33 on the one hand, causing the crank arm 33 to drive the crankshaft 31 to rotate the flywheel 32, on the other hand, it will drive the link 55, so that the link 55 drives the grip 52 to swing back and forth through the swing arm 53.

In this way, the pedal 45 can move along an elliptical trajectory. In addition, when the pedal rod 41 swings back and forth, it will drive the suspension arm 60 to move together. At this time, the suspension arm 60 uses a design that is skewed inward, and then is matched with the design of the pedal rod 41 to swing left and right, so that when the suspension arm 60 swings forward, it guides the pedal 45 to move forward in a straight line direction D1; when the suspension arm 60 swings backward it guides the pedal 45 back along a diagonal direction D2. Thereby, the elliptical trainer 10 of the present invention allows the user to train in a posture that conforms to the human factors engineering to reduce the burden on the lower limb joints and effectively avoid the occurrence of sports injuries.

What is claimed is:

1. An elliptical trainer, comprising:

a machine table comprising a base, an upright set at a front end of said base and two side frames respectively set on opposing left and right sides of said base;

a transmission unit comprising a crankshaft rotatably installed on said upright, a flywheel fixed to said crankshaft to rotate with said crankshaft, and two crank arms having a respective front end thereof fixed to said crankshaft;

two pedal units arranged symmetrically with respect to a first axis, each of said two pedal units comprising a pedal rod, a pedal seat and a pedal, said pedal rod having a front end thereof pivoted to a rear end of a respective one of said two crank arms in an up and down and left and right swingable manner, said pedal seat being pivotable up and down on a top surface of an opposing rear end of said pedal rod, said pedal being fixed on a top surface of said pedal seat;

two armrest units, each of said two armrest units comprising an armrest and a link, said armrest being pivoted to said upright of said machine table in a back and forth swingable manner, said link having a front end thereof pivoted to a bottom end of said armrest in a back and forth swingable manner and an opposing rear end thereof fixed to one respective said pedal seat; and two suspension arms, each of said two suspension arms having a top end thereof pivoted to one respective side frame of said machine table in a back and forth swingable manner and an opposing bottom end thereof pivoted to the rear end of one respective said pedal rod in a back and forth swingable manner, said two suspension arms being symmetrical with respect to said first axis and being respectively skewed in the direction of said pedals, so that said two suspension arms are pivoted around a second axis that is not perpendicular to said first axis;

wherein each of said two suspension arms has an upper oblique section and a lower oblique section connected to said upper oblique section, said upper oblique section is pivoted to the one respective side frame of said machine table in the back and forth swingable manner, and said lower oblique section is pivoted to the rear end of the one respective said pedal rod in the back and forth swingable manner;

wherein a skew angle of said upper oblique section relative to said side frame is smaller than a skew angle of said lower oblique section relative to said side frame.

2. The elliptical trainer as claimed in claim 1, wherein each said pedal rod has a front oblique section and a rear oblique section connected to said front oblique section, said front oblique section having a front end thereof pivoted to the rear end of one respective said crank arm in a left and right swingable manner, said rear oblique section having a rear end thereof pivoted to a bottom end of one of said two suspension arms in a back and forth swingable manner, the inclination angle of said upper oblique section relative to the ground is smaller than the inclination angle of said lower oblique section relative to the ground.

3. The elliptical trainer as claimed in claim 2, wherein said upper oblique section of said pedal rod having a top end thereof pivoted to one respective said side frame of said machine table in a back and forth swingable manner, said lower oblique section of said pedal rod having a bottom end thereof pivoted to the rear end of said rear oblique section of one respective said pedal rod in a back and forth swingable manner.

4. The elliptical trainer as claimed in claim 3, wherein each of said two armrests comprises a grip, a swing arm, a linkage plate, and a multi-direction pivoting member, said grip being pivoted to said upright of said machine table in a back and forth swingable manner, said swing arm being disposed at a front side relative to said grip, said multi-direction pivoting member being provided with a left-and-right pivoting portion and a back-and-forth pivoting portion, said swing arm having a top end thereof pivoted to said upright of said machine table in a back and forth swingable manner and an opposing bottom end thereof pivoted to the left-and-right pivoting portion of said multi-direction pivoting member to swing left and right, and the front end of said link being pivoted to the back-and-forth pivoting portion of said multi-direction pivoting member to swing back and forth, said linkage plate having opposing front and rear ends thereof respectively pivoted to a bottom end of said grip and the top end of said swing arm.

5. The elliptical trainer as claimed in claim 2, wherein each of said two armrests comprises a grip, a swing arm, a linkage plate, and a multi-direction pivoting member, said grip being pivoted to said upright of said machine table in a back and forth swingable manner, said swing arm being disposed at a front side relative to said grip, said multi-direction pivoting member being provided with a left-and-right pivoting portion and a back-and-forth pivoting portion, said swing arm having a top end thereof pivoted to said upright of said machine table in a back and forth swingable manner and an opposing bottom end thereof pivoted to the left-and-right pivoting portion of said multi-direction pivoting member to swing left and right, and the front end of said link being pivoted to the back-and-forth pivoting portion of said multi-direction pivoting member to swing back and forth, said linkage plate having opposing front and rear ends thereof respectively pivoted to a bottom end of said grip and the top end of said swing arm.

6. The elliptical trainer as claimed in claim 1, wherein each of said two armrests comprises a grip, a swing arm, a linkage plate, and a multi-direction pivoting member, said grip being pivoted to said upright of said machine table in a back and forth swingable manner, said swing arm being disposed at a front side relative to said grip, said multi-direction pivoting member being provided with a left-and-right pivoting portion and a back-and-forth pivoting portion, said swing arm having a top end thereof pivoted to said upright of said machine table in a back and forth swingable manner and an opposing bottom end thereof pivoted to the left-and-right pivoting portion of said multi-direction pivoting member to swing left and right, and the front end of said link being pivoted-and-forth pivoting portion of said multi-direction pivoting member to swing back and forth, said linkage plate having opposing front and rear ends thereof respectively pivoted to a bottom end of said grip and the top end of said swing arm.

* * * * *